United States Patent [19]

Perry

[11] 4,004,741

[45] Jan. 25, 1977

[54] GRINDING MECHANISM

[76] Inventor: Eldon E. Perry, 141 North, 600 East, Kaysville, Utah 84037

[22] Filed: Oct. 28, 1975

[21] Appl. No.: 626,064

[52] U.S. Cl. ..... 241/55

[51] Int. Cl.[2] ..... B02C 23/28

[58] Field of Search ..... 241/49, 55, 79.2, 100, 241/277

[56] References Cited

UNITED STATES PATENTS

| | | | |
|---|---|---|---|
| 2,627,376 | 2/1953 | Lee | 241/55 |
| 2,634,915 | 4/1953 | Fisher et al. | 241/55 |
| 2,644,740 | 7/1953 | Dodds et al. | 241/79.2 |
| 2,861,748 | 11/1958 | Miller | 241/55 |

*Primary Examiner*—Granville Y. Custer, Jr.
*Attorney, Agent, or Firm*—Edward E. McCullough

[57] ABSTRACT

A hopper has an adjustable opening into a tube that leads to the interior of a drum-shaped housing containing a grinding impeller that also functions simultaneously as a screw-type fan and as a paddle-type fan, formed to maximize air turbulence at the grinding edges thereof and to separate finely ground material from the coarser particles continuously. The grinding impeller is operated by a motor attached to the outside of the drum-shaped, grinder housing. The impeller is adjustable relative to a dam that partially surrounds a discharge port in one end of the housing. The dam intercepts air from the vortex created by the impeller, to promote flow of material through the discharge port. A tube leads from the discharge port to a separating device above a drawer having a partition therein, so that the coarse material may be dropped into one compartment and the fine material into the other. A valve in the side of the grinder housing, in communication with the discharge tube, permits extraction of partially or coarsely ground material, such as cracked wheat.

15 Claims, 5 Drawing Figures

GRINDING MECHANISM

BACKGROUND OF THE INVENTION

This invention relates to grinding apparatus, and particularly to compact, portable grinders especially adapted for grinding grain.

Conventional mechanism for grinding grain or similar material typically have a grinding chamber, containing a grinding impeller, fed by a hopper for containing the grain. The ground material is then removed from the grinding chamber by a fan that forces air into the chamber from some external position.

Grinders of this type are described in U.S. Pat. No. 2,646,934 "Hammer Mill and Blower Arrangement" by B. T. Sandor and in U.S. Pat. No. 1,931,555 "Grinding Mill" to A. J. Mosley, U.S. Pat. No. 2,152,108 to R. S. Tice discloses a hammer mill for pulverizing ore, wherein the hammer blades act as a blower for discharging the powdered ore through an opening in the side of the housing.

SUMMARY OF THE INVENTION

The present invention provides a number of improvements over the prior art grinders and it is more compact and versatile than conventional grinding mechanisms.

An outer housing or support means holds a hopper having an adjustable opening into a tube that is capable of feeding the grain from the hopper into a drum-shaped grinder housing.

The grinder housing has the form of a truncated cone, and is equipped with radial cooling fins on the outside. A combination fan and grinding impeller is fixed to a shaft that extends through one wall of the housing to a motor by which it is rotated. The inlet port is in the larger side of the grinder housing and the impeller-fan is rotated in a direction to draw material for grinding, such as grain, into the housing. The discharge port is in the opposite end and is partially surrounded, on the downstream side thereof (relative to the vortex of air created by the impeller) to form a pocket of compressed air that tends to force the finely ground material through the discharge port to prevent clogging. The dam has a curved surface oblique to the direction of the vortex of air, so that large particles striking this surface are deflected back into the grinding chamber and into the path of the impeller blades.

Each impeller blade is twisted at its inner end in the same direction from a plane perpendicular to the shaft at the center to a plane parallel thereto at the end of the blade, so that the impeller may function as a fan and create maximum turbulence for efficient grinding. In effect, a screw-type fan is provided by the central portion of the impeller and a paddle-type at the outside portion thereof. Since the blade portions that form the central, screw-type fan of the impeller describe smaller circles as the impeller is rotated than do the outer portions that form the paddle-type fan, the same impeller is able to perform two distinct functions simultaneously. The outer, high-velocity, paddle-fan portion creates a powerful vortex of air that exerts centrifugal force on the large particles to be ground, that maintains them in the vicinity of the paddles and in the area of maximum violence. Air turbulence in this region is further increased by a hole in each paddle. At the same time, the central, screw-fan portion of the impeller operates at relatively low velocity in a low-pressure region and functions to draw material to be ground through the inlet port and to eject finely ground material through the discharge port. In this way finely ground particles are continuously and automatically being ejected from the grinding chamber, while the coarser particles are being retained therein until ground.

This feature not only promotes efficient grinding of grain, etc., but also it makes possible the easy extraction of cracked wheat or other coarse particles free from flour or powdered material. This is accomplished by a valve in the circular wall of the grinder housing that when opened permits cracked wheat to escape from its position along the wall of the chamber.

A tube connected to the discharge port has a venturi near its free end, which is connected to a separation device. This separator is essentially a screen spaced a small distance from the end of the tube and near a partition in a drawer; so that the coarser particles being ejected through the tube will strike the screen and fall into the nearer compartment of the drawer, while the fine particles, accelerated by the venturi, pass through the screen and fall into the farther compartment of the drawer.

It has been found that, by dampening wheat with water before introducing it into the grinder, the bran may be stripped from the wheat and extracted intact through the discharge port.

Objects of the invention are to provide a compact, efficient, and versatile grinder; to provide such a grinder wherein the grinding impeller functions also as the only fan to draw grain or other material into the grinding chamber and to eject the ground material; to provide extra air pressure at the discharge port to prevent clogging thereof; and to provide a grinder that can also produce either cracked wheat or bran, as well as flour, when wheat is ground.

Other objects and advantages of the invention will become apparent as the following detailed description is read with reference to the accompanying drawings. The same parts are designated by the same numbers throughout the disclosure.

DESCRIPTION OF THE PREFERRED EMBODIMENTS

Figure 1:
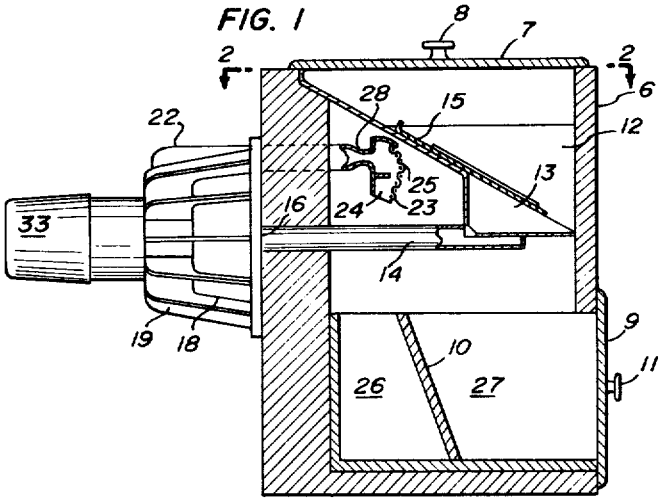
FIG. 1 is a sectional view of the entire invention.
Figure 5:
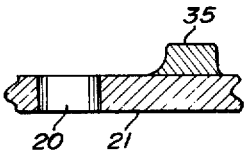
FIG. 5 is an enlarged, fragmentary section taken on line 5—5 of FIG. 4, and rotated 90°.
Figure 2:
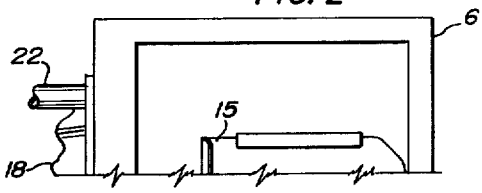
FIG. 2 is a fragmentary view taken on line 2—2 of FIG. 1.
Figure 3:
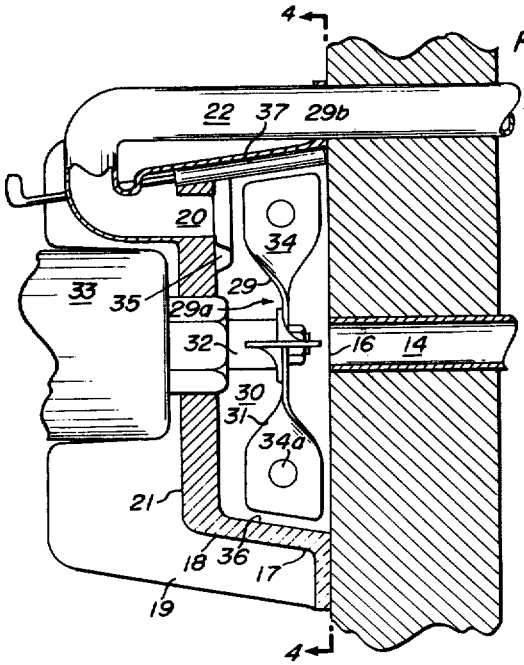
FIG. 3 is a sectional view of the grinder and associated parts.
Figure 4:
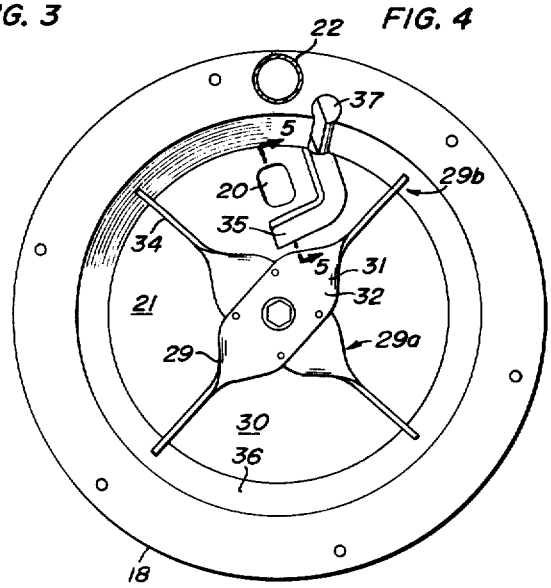
FIG. 4 is a full section taken on line 4—4 of FIG. 3.

A cabinet-like, outer housing 6 has a top lid 7 equipped with a knob 8 and, in the lower portion thereof, a drawer 9 having a partition 10 and a knob 11. Directly below the lid 7 is a hopper 12 for holding grain or other material to be ground. The hopper 12 terminates in a small chute 13 that opens into a tube 14. A slide or gate valve 15 between the hopper 12 and chute 13 is used to meter the flow of grain being funneled into the tube 14 via the chute 13.

The tube 14 is connected to the inlet port 16 of the large end 17 of the grinder housing 18. This housing 18 has the form of a hollow, truncated cone equipped with radially extending cooling fins 19. The discharge port 20, in the small end 21 of the grinder housing 18, leads to a second tube 22 that extends over the drawer 9. A separator 23 is fastened to the end of the tube 22 and is positioned adjacent the partition 10 of the drawer 9, but on the side thereof nearest the grinder housing 18. The separator 23 comprises two side members 24, each fastened to the tube 22, that hold a screen 25 directly in front of the open end of the tube 22 and somewhat canted thereto. Large particles of partially ground material, such as cracked wheat or bran, strike the screen 25 and are deflected thereby downwardly into the first compartment 26 of the drawer 9. The air carrying the ground material through the tube 22 is accelerated by a venturi 28 between the end of the tube 22 and the separator 23; so that the finely ground material, passing through the screen 25, is carried well beyond the drawer partition 10 and falls into the second compartment 27 of the receptacle or drawer 9.

The grinder housing 18 contains a grinding impeller 29 that is formed to function also as two types of fan. In a preferred embodiment, the impeller 29 is made of two thin metal bars 31, mutually perpendicular and fastened together at their centers, at which point they are also fixed to the shaft 32, attached to that of an electric motor 33. The motor 33 is attached to the outside of the small end 21 of the grinder housing 18. Each of the bars 31 is twisted 90° between its central portion and its end portion in the same direction so that the end portions 34 are parallel to the motor shaft 32. Each of these end portions 34 also has at least one hole **34*a* therein to increase air turbulence as the impeller 29 is rotated. The holes 34*a*** have been found to increase the fineness of the resulting flour to a marked degree.

The blades or bars 31 of the impeller 29 are formed to create a screw-type fan **29*a* at their inner portions to draw air through the inlet port 16 and to force it out through the discharge port 20. This is the general airflow pattern through the central, low-pressure region of the grinding chamber 30. This general pattern tends to carry the finely ground material to and through the discharge port 20. This action is enhanced at the discharge port 20 by a small dam 35 that partially surrounds the discharge port 20 on the downstream side thereof, relative to the vortex of air created by the outer, paddletype fan portion of the impeller 29. It forms a pocket of compressed air that helps to force finely ground material through the discharge port 20 and to keep that port free of material that would otherwise tend to block it. Although the dam 35 is shown in the drawings as an L-shaped bar, it should be noted that it could be any surface irregularity adjacent the discharge port 20 that would intercept air from the vortex created by the impeller to help force finely ground material through the discharge port 20. This port is spaced away from the circular wall 36 of the grinder housing 18 to avoid intercepting the coarse, unground particles that migrate to the wall. In this sense, the spacing of the discharge port 20 from the wall 36 comprises a classifying means for determining the fineness of the particles passing therethrough. However, the discharge port 20 and the dam 35 are located near enough to the wall 36 to benefit from the high velocity air flow created by the paddle fan 29b**.

It has been found that, although the general airflow pattern through the center of the grinding chamber 30 tends to carry material from the inlet port to the discharge port, the larger particles are carried by centrifugal force to the circular wall 36 of the chamber and to the larger end thereof. This not only maintains such particles in positions to be acted on effectively by the impeller 29, but also permits easy extraction of cracked wheat, or other coarse particles from the chamber 30. A valve 37 is provided for this purpose. It is located in the circular wall 36 of the grinder housing 18; and, by rotating the valve 37, the chamber 30 is opened to the discharge tube 22, whereby the cracked wheat may be withdrawn. The valving member 37 tends to increase the particle sizes of the material passing therethrough as its opening is increased. Hence, it may function as a classifier. It has to form a cylinder with a flattened portion.

An invention has been described that constitutes an advance in the grinding art. Although the embodiments have been described specifically, it should be noted that many details thereof may be altered without departing from the scope of the invention, as it is defined in the following claims.

The invention claimed is:

1. A grinding mechanism, for grinding grain and similar material, comprising:

a hopper for holding material to be ground;

a drum-shaped grinder housing having an inlet port connected to the hopper and an eccentrically located discharge port;

a grinding impeller in the grinder housing, having radial, paddle-type blades fixed to a shaft that extends through at least one end of the housing;

a dam on the inside surface of the grinder housing adjacent and partially surrounding the discharge port on the downstream side thereof relative to the motion of the impeller blades, so that the dam will intercept air from the vortex created by the impeller to aid in forcing finely ground material through the discharge port and maintain the discharge port in an unclogged condition; and a motor attached to the grinder housing and to the impeller shaft for rotating the impeller.

2. The grinding mechanism of claim 1 wherein each impeller blade is twisted in the same direction from its portion of attachment to the shaft to form a central, screw-fan portion and the grinder housing has the form of a hollow, truncated cone wherein the inlet port is in the large end and the discharge port is in the smaller end, to assist in continuous separation of finely ground material from coarse particles—the fine material being moved axially through the housing toward the discharge port in the small end of the housing by the screw-fan portion of the impeller and the coarse material being maintained along the curved wall and toward the large end of the housing by centrifugal force in the vortex of air created by the outer, paddle-fan portion of the impeller.

3. The grinding mechanism of claim 1, further including radial, cooling fins on the outside of the grinder housing.

4. The grinding mechanism of claim 1 wherein the paddle portion of at least one impeller blade has at least one hole to increase air turbulence and to provide greater grinding capability.

5. The grinding mechanism of claim 1 wherein the surface of the dam adjacent the discharge port is angled and curved approximately 45° relative to the end of the grinder housing to deflect coarse particles, that may strike it, toward the impeller.

6. The grinding mechanism of claim 1 further including a valve between the hopper and grinder housing for adjusting the flow of material to be ground.

7. The grinding mechanism of claim 1 further including a valve in the curved wall of the grinder housing, and open to a discharge port, for extracting coarse particles therefrom.

8. The grinding mechanism of claim 7 wherein said valve in the curved wall has the form of a circular cylinder with a flattened portion, the cylindrical surface of which closes a slot in the wall of the housing, while the flattened portion opens it to the desired extent, whereby the valve may classify the particles permitted to pass therethrough by the extent to which it is opened.

9. The grinding mechanism of claim 1 further including a cabinet-like outer housing containing the hopper in its upper portion and a removable receptacle in its lower portion positioned to receive ground material from the discharge port of the grinder.

10. The grinding mechanism of claim 9 wherein the receptacle is a drawer equipped with a pull knob and having a partition dividing it into a first compartment and a second compartment; and further including a tube connected to the discharge port of the grinder and a separator attached to the end of the tube and positioned thereby over the first compartment of the drawer adjacent the partition, the separator comprising a venturi on the end of the tube to accelerate the air and ground material passing therethrough and a screen fixed to the end of the venturi, with an opening at the lower portion between the venturi and screen, whereby the coarse particles passing through the tube strike the screen and drop into the first compartment of the drawer while the finer material passes through the screen and falls into the second compartment.

11. The grinder, for grinding grain and similar material, comprising:

a housing having the form of a hollow, truncated cone with an inlet port in the large end and a discharge port in the smaller end;

a combined impeller and fan axially positioned in the housing having a shaft that extends through an end of the housing and a plurality of blades extending radially from the shaft, each blade being twisted in the same direction about 90° near its inner end to provide a central, screw-type fan for moving air and ground material from the inlet port to the discharge port, and so that the outer end portion of each blade is parallel to the shaft to provide an outer, paddle-type, impeller-fan, whereby a vortex of air is created in the housing, which carries coarse particles to the outer, high velocity edges of the impeller and whereby the fine material is continuously separated from the coarse particles and removed from the housing; and a motor fixed to the outside of the housing and attached to the shaft for rotating the impeller.

12. The grinder of claim 11 further including cooling fins on the outside of the housing.

13. The grinder of claim 11 further including a dam on the inside of the smaller end of the housing partially surrounding the downstream side of the discharge port, relative to the direction of rotation of the impeller.

14. The grinder of claim 13 wherein the discharge port and its dam are located near the conical wall of the housing to take advantage of the high velocity flow of air created by the paddle-fan portion of the impeller.

15. A grinding mechanism, for grinding grain and similar material, comprising:

a cabinet-like, outer housing;

a hopper in the upper portion of the housing for holding material to be ground;

a grinder housing having the form of a hollow, truncated cone with an inlet port in the large end, connected to the hopper, and a discharge port in the smaller end;

cooling fins on the outside of the grinder housing;

an impeller in the housing having a central shaft that extends through the smaller end thereof and a plurality of blades extending radially from the shaft, each blade being twisted approximately 90° at its inner end to form a central, screw fan and terminating in a paddle, parallel to the shaft, to form an outer, paddle fan, whereby centrifugal force exerted on coarse particles being ground by the vortex of air created by rotation of the paddle fan causes them to migrate to the conical wall of the large end of the grinder housing, while the finely ground material is continuously removed through the discharge port by the central, screw fan of the impeller, operating in the central, low-pressure region of the grinder housing;

a dam partially surrounding the discharge port on the downstream side thereof, relative to the direction of rotation of the impeller;

a motor attached to the outside of the grinder housing and attached to the impeller shaft for rotating it;

a drawer in the lower portion of the outer housing, having a partition that divides it into a first compartment and a second compartment;

a tube extending from the discharge port over the first compartment of the drawer, near the partition thereof;

a venturi on the end of the tube;

a screen attached to the venturi and having an opening at the lower portion thereof, so that ground material passing therethrough is accelerated by the venturi, coarse particles strike the screen and drop into the first compartment while the fine material passes through the screen and falls into the second; and a cylindrical valving member having a flattened portion and located in the conical wall of the grinder housing, adjacent a slot therein so that rotation of the valving member opens or closes the slot by rotating the curved or flattened portion of the valve member relative thereto, the slot being open to a discharge port.

* * * * *